US011283185B2

(12) United States Patent
Wu et al.

(10) Patent No.: US 11,283,185 B2
(45) Date of Patent: Mar. 22, 2022

(54) ANTENNA STRUCTURE AND MODULATION METHOD THEREFOR

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Jie Wu, Beijing (CN); Tien Lun Ting, Beijing (CN); Xiangzhong Kong, Beijing (CN); Xue Cao, Beijing (CN); Ying Wang, Beijing (CN); Liang Li, Beijing (CN); Peizhi Cai, Beijing (CN); Chuncheng Che, Beijing (CN)

(73) Assignees: BEIJING BOE OPTOELECTRONICS TECHNOLOGY CO., LTD., Beijing (CN); BOE TECHNOLOGY GROUP CO,, LTD., Beijing (CN)

( * ) Notice: Subject to any disclaimer, the term of this patent is extended or adjusted under 35 U.S.C. 154(b) by 132 days.

(21) Appl. No.: 16/609,822

(22) PCT Filed: Apr. 3, 2019

(86) PCT No.: PCT/CN2019/081310
§ 371 (c)(1),
(2) Date: Oct. 31, 2019

(87) PCT Pub. No.: WO2019/196725
PCT Pub. Date: Oct. 17, 2019

(65) Prior Publication Data

US 2020/0059005 A1 Feb. 20, 2020

(30) Foreign Application Priority Data

Apr. 8, 2018 (CN) ..... 201810307536.6

(51) Int. Cl.
*H01Q 9/04* (2006.01)
*H01Q 15/24* (2006.01)
*H01P 1/18* (2006.01)

(52) U.S. Cl.
CPC ..... *H01Q 15/244* (2013.01); *H01P 1/18* (2013.01); *H01Q 9/045* (2013.01); *H01Q 9/0435* (2013.01)

(58) Field of Classification Search
CPC .. H01Q 9/0428; H01Q 9/0435; H01Q 9/0442; H01Q 9/045; H01Q 15/242;
(Continued)

(56) References Cited

U.S. PATENT DOCUMENTS 3,478,362 A 11/1969 Ricardi et al.
4,737,793 A 4/1988 Munson et al.
(Continued)

FOREIGN PATENT DOCUMENTS

CN 105425496 A 3/2016
CN 105789872 A 7/2016
(Continued)

OTHER PUBLICATIONS

Search report issued for EP Application No. 19784231.3, dated Nov. 23, 2021, 8 pages.
(Continued)

*Primary Examiner* — Tho G Phan
(74) *Attorney, Agent, or Firm* — Dave Law Group LLC; Raj S. Dave

(57) ABSTRACT

An antenna structure and a modulation method therefor are provided. The antenna structure includes a radiation patch, a radio-frequency port, a first signal line, a second signal line, a power divider, and a first phase modulator. The radiation patch includes a first feed point and a second feed point. One end of the first signal line is connected to the first
(Continued)

feed point. One end of the second signal line is connected to the second feed point. The power divider is separately connected to the radio-frequency port, the other end of the first signal line, and the other end of the second signal line, and is configured to allocate electromagnetic waves of the radio-frequency port to the first signal line and the second signal line; and the first phase modulator is configured to modulate the phase of the electromagnetic waves of the first signal line.

19 Claims, 4 Drawing Sheets

(58) Field of Classification Search
CPC .... H01Q 15/244; H01Q 15/246; H01Q 11/14; H01Q 9/04; H01Q 15/24; H01Q 1/38; H01Q 1/50; H01P 1/18; H01P 1/184
See application file for complete search history.

(56) References Cited

U.S. PATENT DOCUMENTS 7,675,466 B2 * 3/2010 Gaucher ..... H01Q 21/0075 343/700 MS
7,847,748 B1 * 12/2010 McKinley ..... H01Q 9/0435 343/756
9,059,496 B2 * 6/2015 Glushchenko ..... B82Y 20/00
9,887,456 B2 * 2/2018 Bily ..... H01Q 21/0031
9,979,072 B2 * 5/2018 Choi ..... H01Q 1/2216
10,476,119 B2 * 11/2019 Borysenko ..... H01P 5/222
10,567,146 B1 * 2/2020 Fink ..... G06K 7/10069
10,686,257 B2 * 6/2020 Haziza ..... H01Q 25/00
10,892,554 B2 * 1/2021 Yamada ..... H01Q 3/26
11,063,363 B2 * 7/2021 Komura ..... H01Q 15/24
11,165,150 B2 * 11/2021 Park ..... H01Q 9/065
2014/0022029 A1 1/2014 Glushchenko et al.
2020/0212539 A1 * 7/2020 Yun ..... H01Q 9/0414

FOREIGN PATENT DOCUMENTS

CN 208315751 U 1/2019
JP 2001007631 A 1/2001

OTHER PUBLICATIONS

Onur Hamza Karabey et al. "Continuously Polarization Agile Antenna by Using Liquid Crystal-Based Tunable Variable Delay Lines", IEEE Transactions on Antennas and Propagation, Jan. 2013, vol. 61, No. 1.

* cited by examiner

ANTENNA STRUCTURE AND MODULATION METHOD THEREFOR

. CROSS-REFERENCE

The present application is the U.S. national stage of International Patent Application No. PCT/CN2019/081310, filed on Apr. 3, 2019, which claims priority to Chinese patent application No. 201810307536.6, filed on Apr. 8, 2018, the entire disclosures of which are incorporated herein by reference as part of the present application.

TECHNICAL FIELD

Embodiments of the present disclosure relate to an antenna structure, and a modulation method thereof.

BACKGROUND

With the continuous development of communication technology, antennas have gradually developed towards the technical directions such as miniaturization, broadband, multi-band and high gain. Compared with traditional antennas, such as horn antennas, spiral antennas and array antennas, liquid crystal antennas are more suitable for the current technical development direction.

In addition, a polarization characteristic of an antenna is defined by a spatial orientation of an electric field intensity vector of an electromagnetic wave radiated by the antenna in the maximum radiation direction. The polarization types are divided by the motion trajectory of a vector end of the electric field intensity vector. The polarization characteristic of the antenna can be divided into line polarization, circular polarization and elliptical polarization. Line polarization is divided into horizontal polarization and vertical polarization. Circular polarization is divided into left-handed circular polarization and right-handed circular polarization.

It can be called circular polarization that an angle between a polarization plane of the electromagnetic wave radiated by the antenna and a normal plane of the earth changes periodically from 0 to 360 degrees, i.e., the magnitude of the electric field is constant, the direction of the electric field changes with time, and a projection of the motion trajectory of the end of the electric field intensity vector on a plane perpendicular to the propagation direction is a circle. Circular polarization can be obtained when the amplitudes of the horizontal component and the vertical component of the electric field are equal and the phase difference of the horizontal component and the vertical component is 90 degrees or 270 degrees. Circular polarization is defined as right-handed circular polarization if the polarization plane rotates with time and has a right-handed spiral relationship with the propagation direction of the electromagnetic wave. On the contrary, circular polarization is defined as left-handed circular polarization if the polarization plane rotates with time and has a left-handed spiral relationship with the propagation direction of the electromagnetic wave.

SUMMARY

Embodiments of the present disclosure provide an antenna structure and a modulation method thereof. The antenna structure includes: a radiation patch, a radio frequency port, a first signal line, a second signal line, a power divider, and a first phase modulator. The radiation patch includes a first feed point and a second feed point; one end of the first signal line is connected with the first feed point; one end of the second signal line is connected with the second feed point; the power divider is respectively connected with the radio frequency port, the other end of the first signal line, and the other end of the second signal line, and configured to distribute an electromagnetic wave of the radio frequency port to the first signal line and the second signal line; and the first phase modulator is configured to modulate a phase of an electromagnetic wave of the first signal line.

At least one embodiment of the present disclosure provides an antenna structure, which includes: a radiation patch, including a first feed point and a second feed point; a radio frequency port; a first signal line, one end of the first signal line being connected with the first feed point; a second signal line, one end of the second signal line being connected with the second feed point; a power divider, respectively connected with the radio frequency port, the other end of the first signal line, and the other end of the second signal line, and configured to distribute an electromagnetic wave of the radio frequency port to the first signal line and the second signal line; and a first phase modulator, configured to modulate a phase of an electromagnetic wave of the first signal line.

For example, in the antenna structure provided by an embodiment of the present disclosure, a difference between a power of the electromagnetic wave of the first signal line and a power of an electromagnetic wave of the second signal line is less than 50% of the larger one of the power of the electromagnetic wave of the first signal line and the power of the electromagnetic wave of the second signal line.

For example, in the antenna structure provided by an embodiment of the present disclosure, the power divider is configured to distribute the electromagnetic wave of the radio frequency port to the first signal line and the second signal line with equal power.

For example, in the antenna structure provided by an embodiment of the present disclosure, the antenna structure further includes a first substrate, and the first phase modulator includes: a second substrate, opposite to the first substrate; a first liquid crystal layer, sandwiched between the first substrate and the second substrate; and a first common electrode and a first drive electrode, one of the first common electrode and the first drive electrode being located on a side of the first liquid crystal layer close to the first substrate, and the other of the first common electrode and the first drive electrode being located on a side of the first liquid crystal layer close to the second substrate. An orthographic projection of the first signal line on the first substrate is at least partially overlapped with an orthographic projection of the first liquid crystal layer on the first substrate.

For example, the antenna structure provided by an embodiment of the present disclosure further includes: a second phase modulator, configured to modulate a phase of an electromagnetic wave of the second signal line.

For example, in the antenna structure provided by an embodiment of the present disclosure, the second phase modulator includes: a third substrate, opposite to the first substrate; a second liquid crystal layer, sandwiched between the first substrate and the third substrate; and a second common electrode and a second drive electrode, one of the second common electrode and the second drive electrode being located on a side of the second liquid crystal layer close to the first substrate, and the other of the second common electrode and the second drive electrode being located on a side of the second liquid crystal layer close to the third substrate. An orthographic projection of the second signal line on the first substrate is at least partially overlapped with an orthographic projection of the second liquid crystal layer on the first substrate.

For example, in the antenna structure provided by an embodiment of the present disclosure, a dielectric constant range of liquid crystal molecules in the first liquid crystal layer includes $\varepsilon_{\parallel}1-\varepsilon_{\perp}2$, and a length $L_1$ of a portion of the first signal line overlapped with the first liquid crystal layer satisfies:

$$\frac{2\pi f_1 L_1}{c}\left|\sqrt{\varepsilon_{\parallel}1}-\sqrt{\varepsilon_{\perp}2}\right| \geq \frac{\pi}{2},$$

where $\varepsilon_{\parallel}1$ is a parallel dielectric constant of the liquid crystal molecules in the first liquid crystal layer, $\varepsilon_{\perp}2$ is a vertical dielectric constant of the liquid crystal molecules in the first liquid crystal layer, c is the speed of light, and $f_1$ is frequency of the electromagnetic wave of the first signal line.

For example, in the antenna structure provided by an embodiment of the present disclosure, a dielectric constant range of liquid crystal molecules of the second liquid crystal layer includes $\varepsilon_{\parallel}3-\varepsilon_{\perp}4$, and a length $L_2$ of a portion of the second signal line overlapped with the second liquid crystal layer satisfies:

$$\frac{2\pi f_2 L_2}{c}\left|\sqrt{\varepsilon_{\parallel}3}-\sqrt{\varepsilon_{\perp}4}\right| \geq \frac{\pi}{2},$$

where $\varepsilon_{\parallel}2$ is a parallel dielectric constant of the liquid crystal molecules in the second liquid crystal layer, $\varepsilon_{\perp}2$ is a vertical dielectric constant of the liquid crystal molecules in the second liquid crystal layer, c is the speed of light, and $f_2$ is frequency of the electromagnetic wave of the second signal line.

For example, in the antenna structure provided by an embodiment of the present disclosure, the first signal line is located between the second substrate and the first drive electrode, or between the second substrate and the first common electrode.

For example, in the antenna structure provided by an embodiment of the present disclosure, the second signal line is located between the third substrate and the second drive electrode, or between the third substrate and the second common electrode.

For example, in the antenna structure provided by an embodiment of the present disclosure, the first signal line is located on a side of the first liquid crystal layer away from the first common electrode, and the second signal line is located on a side of the second liquid crystal layer away from the second common electrode.

For example, in the antenna structure provided by an embodiment of the present disclosure, the second substrate and the third substrate are a same substrate, the first liquid crystal layer and the second liquid crystal layer are disposed in a same layer, and the first common electrode and the second common electrode are a same common electrode.

For example, in the antenna structure provided by an embodiment of the present disclosure, the radiation patch is located on a side of the second substrate away from the first liquid crystal layer.

For example, in the antenna structure provided by an embodiment of the present disclosure, the radiation patch is located on a side of the second substrate close to the first liquid crystal layer, and is in the same layer as the first signal line.

For example, in the antenna structure provided by an embodiment of the present disclosure, an orthographic projection of the radiation patch on the first substrate is overlapped with the orthographic projection of the first liquid crystal layer or the second liquid crystal layer on the first substrate.

For example, in the antenna structure provided by an embodiment of the present disclosure, a first connection line between the first feed point and a center of the radiation patch is perpendicular to a second connection line between the second feed point and the center of the radiation patch.

For example, in the antenna structure provided by an embodiment of the present disclosure, an orthographic projection of the first phase modulator on the first substrate is located on a side of an orthographic projection of the radiation patch on the first substrate where the first feed point is located, and an orthographic projection of the second phase modulator on the first substrate is located on a side of an orthographic projection of the radiation patch on the first substrate where the second feed point is located.

For example, in the antenna structure provided by an embodiment of the present disclosure, an orthographic projection of the first phase modulator on the first substrate is spaced apart from an orthographic projection of the radiation patch on the first substrate, and an orthographic projection of the second phase modulator on the first substrate is spaced apart from an orthographic projection of the radiation patch on the first substrate.

For example, a number of the radio frequency port is one.

At least one embodiment of the present disclosure provides a modulation method of an antenna structure, the antenna structure includes the abovementioned antenna structure, the modulation method including: inputting an electromagnetic wave into the radio frequency port, the electromagnetic wave being a line polarization wave; distributing the line polarization wave to the first signal line and the second signal line by the power divider; and modulating a phase of a line polarization wave of the first signal line by the first phase modulator so that the phase of the line polarization wave of the first signal line changes and is orthogonal to a phase of a line polarization wave of the second signal line.

For example, in the modulation method provided by an embodiment of the present disclosure, a difference between a power of an electromagnetic wave of the first signal line and a power of an electromagnetic wave of the second signal line is less than 50% of the larger one of the power of the electromagnetic wave of the first signal line and the power of the electromagnetic wave of the second signal line.

For example, in the modulation method provided by an embodiment of the present disclosure, distributing the line polarization wave to the first signal line and the second signal line by the power divider includes: distributing the electromagnetic wave of the radio frequency port to the first signal line and the second signal line with equal power by the power divider.

For example, in the modulation method provided by an embodiment of the present disclosure, the antenna structure further includes a second phase modulator, configured to modulate the phase of the electromagnetic wave of the second signal line, and modulating the phase of the line polarization wave of the first signal line by the first phase modulator so that the phase of the line polarization wave of the first signal line changes and is orthogonal to the phase of the line polarization wave of the second signal line further includes: modulating the phase of the line polarization wave of the second signal line by the second phase modulator so that the phase of the line polarization wave of the second signal line changes.

BRIEF DESCRIPTION OF THE DRAWINGS

In order to clearly illustrate the technical solution of embodiments of the present disclosure, the drawings of the embodiments will be briefly described in the following, it is obvious that the drawings in the description are only related to some embodiments of the present disclosure and not limited to the present disclosure.

DETAILED DESCRIPTION

Figure 1:
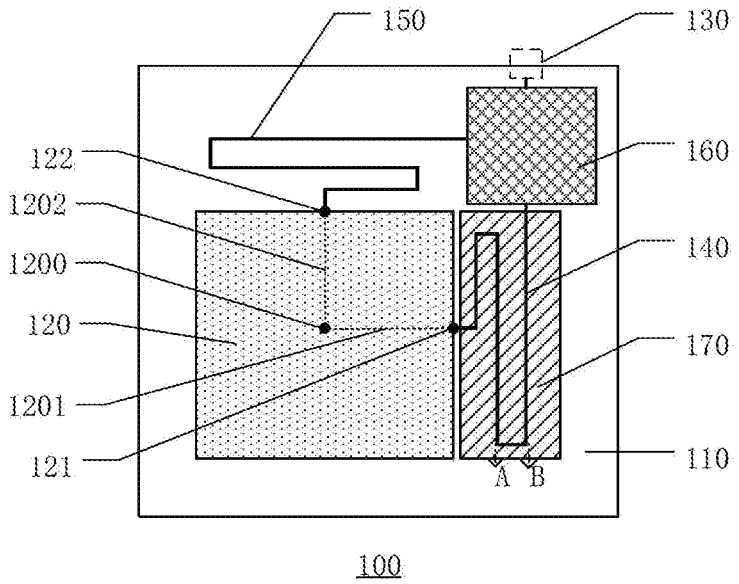
FIG. 1 is a schematic plan view of an antenna structure according to an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

The inventor(s) of the present application has noticed that, with the continuous development of communication technology, there are more and more application scenarios for wireless communication. Some communication devices need to receive or transmit line polarization signals, some communication devices need to receive or transmit left-handed circular polarization signals, and some communication devices need to receive or transmit right-handed circular polarization signals. However, some application scenarios and equipment now have strict requirements on the size of antennas, and multiple antennas with a single polarization cannot be installed at the same time.

In this regard, embodiments of the present disclosure provide an antenna structure and a modulation method thereof. The antenna structure includes a radiation patch, a radio frequency port, a first signal line, a second signal line, a power divider and a first phase modulator. The radiation patch includes a first feed point and a second feed point; one end of the first signal line is connected with the first feed point; one end of the second signal line is connected with the second feed point; the power divider is respectively connected with the radio frequency port, the other end of the first signal line, and the other end of the second signal line, and configured to distribute an electromagnetic wave of the radio frequency port to the first signal line and the second signal line; and the first phase modulator is configured to modulate a phase of the electromagnetic wave of the first signal line. Therefore, the antenna structure can distribute the electromagnetic wave from the same radio frequency port to the first signal line and the second signal line through the power divider, and modulate the phase of the electromagnetic wave of the first signal line through the first phase modulator, thus realizing receiving and transmitting a left-handed circular polarization wave, a right-handed circular polarization wave, and a line polarization wave by utilizing a single radio frequency port.

Hereinafter, the antenna structure and the modulation method thereof provided by the embodiments of the present disclosure will be described in detail below with reference to the accompanying drawings.

FIG. 1 is a schematic plan view of an antenna structure according to an embodiment of the present disclosure. As illustrated by FIG. 1, the antenna structure 100 includes: a first substrate 110; a radiation patch 120 including a first feed point 121 and a second feed point 122; a radio frequency port 130; a first signal line 140, one end of which being connected to the first feed point 121; a second signal line 150, one end of which being connected to the second feed point 122; a power divider 160, respectively connected with the radio frequency port 130, the other end of the first signal line 140, and the other end of the second signal line 150, and configured to distribute an electromagnetic wave of the radio frequency port 130 to the first signal line 140 and the second signal line 150; and a first phase modulator 170, configured to modulate a phase of the electromagnetic wave of the first signal line 140. For example, an orthographic projection of the first phase modulator 170 on the first substrate 110 is at least partially overlapped with an orthographic projection of the first signal line 140 on the first substrate 110, so that the first phase modulator 170 can modulate the phase of the electromagnetic wave of the first signal line 140. It should be noted that, the connection between the first signal line and the first feed point can be either an electrical connection or a coupling connection. The connection between the second signal line and the second feed point can be either an electrical connection or a coupling connection. The power divider herein can be an ordinary power divider, which is a device that divides the energy of an input signal into at least two paths of equal or unequal energy to output.

In the antenna structure provided by the embodiment of the present disclosure, upon the electromagnetic wave of the radio frequency port 130 being a line polarization wave, the power divider 160 distributes the line polarization wave of the radio frequency port 130 to the first signal line 140 and the second signal line 150, that is, the electromagnetic waves of the first signal line 140 and the second signal line 150 both are line polarization waves. And then the first phase modulator 170 modulates the phase of the electromagnetic wave of the first signal line 140. For example, a number of radio frequency port 130 is one. Upon a phase difference between a first line polarization wave of the first signal line 140 modulated by the first phase modulator 170 and a second line polarization wave of the second signal line 150 being, for example, ±90 degrees, the first line polarization wave of the first signal line 140 and the second line polarization wave of the second signal line 150 can form a circular polarization wave on the radiation patch 120, which is received and transmitted from the radiation patch 120. Upon the phase difference between the first line polarization wave on the first signal line 140 modulated by the first phase modulator 170 and the second line polarization wave on the second signal line 150 being 0 degree, the first line polarization wave of the first signal line 140 and the second line polarization wave of the second signal line 150 can form a line polarization wave on the radiation patch 120, which is received and transmitted from the radiation patch 120. Upon the antenna structure provided by the embodiment of the present disclosure receiving a circular polarization wave (including a left-handed circular polarization wave or a right-handed circular polarization wave), the circular polarization wave can be decomposed into two line polarization waves orthogonal to each other at the radiation patch 120 and transmitted to the radio frequency port 130 through the first signal line 140 and the second signal line 150 respectively. Thus, by controlling the first phase modulator 170, the antenna structure can receive and transmit a left-handed circular polarization wave, a right-handed circular polarization wave, and a line polarization wave using a single radio frequency port (e.g., one radio frequency port). It should be noted that, the abovementioned circular polarization wave includes a perfect circular polarization wave or an elliptically polarization wave. Upon an axial ratio of a circular polarization wave being 1, the circular polarization wave is a perfect circular polarization wave. Upon an axial ratio of a circular polarization wave being greater than 1, the circular polarization wave is an elliptically polarization wave.

It should be noted that, upon a phase difference between a phase of the first line polarization wave of the first signal line 140 and a phase of the second line polarization wave of the second signal line 150 being not ±90 degrees and not 0 degree, an elliptically polarization wave is formed on the radiation patch 120. Upon the power of the first line polarization wave of the first signal line 140 and the power of the second line polarization wave of the second signal line 150 being not equal, an elliptically polarization wave is also formed on the radiation patch 120. Upon the power of the first line polarization wave of the first signal line 140 and the power of the second line polarization wave of the second signal line 150 being equal and the phase difference being ±90 degrees, a perfect circular polarization wave is formed on the radiation patch 120.

For example, in some examples, a difference between the power of the electromagnetic wave of the first signal line and the power of the electromagnetic wave on the second signal line is less than 50% of the larger value of the power of the electromagnetic wave of the first signal line and the power of the electromagnetic wave of the second signal line. Therefore, it can be guaranteed that the formed circular polarization wave has a small axial ratio, which is more beneficial to the transmission and reception of information.

For example, in some examples, the power divider is configured to distribute the electromagnetic wave of the radio frequency port to the first signal line and the second signal line with equal power. That is, the first line polarization wave of the first signal line and the second line polarization wave of the second signal line are line polarization waves of the equal power, so that the formed circular polarization wave is a perfect circular polarization wave, thereby further facilitating the transmission and reception of information. It should be noted that the above-mentioned "with equal power" refers to dividing the electromagnetic wave signal of the radio frequency port into two electromagnetic wave signals, and the two electromagnetic wave signals have the equal power.

For example, in some examples, as illustrated by FIG. 1, a first connection line 1201 between the first feed point 121 and a center 1200 of the radiation patch 120 is perpendicular to a second connection line 1202 between the second feed point 122 and the center 1200 of the radiation patch 120. Therefore, it can be guaranteed that the line polarization waves of the first feed point 121 and the second feed point 122 are orthogonal, thereby facilitating the formation of a circular polarization wave.

Figure 2A:
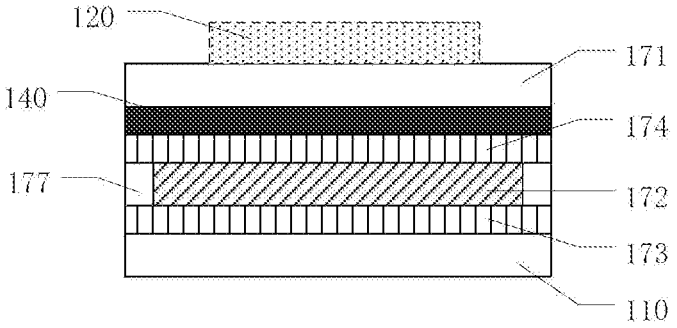
FIG. 2A is a schematic cross-sectional view of a first phase modulator in an antenna structure according to an embodiment of the present disclosure.

FIG. 2A is a schematic cross-sectional view of a first phase modulator in an antenna structure according to an embodiment of the present disclosure. FIG. 2A is a schematic cross-sectional view taken along line AB shown in FIG. 1. As illustrated by FIG. 2A, the first phase modulator 170 includes a second substrate 171 disposed opposite to the first substrate 110, a first liquid crystal layer 172, a first common electrode 173 and a first drive electrode 174 sandwiched between the first substrate 110 and the second substrate 171. One of the first common electrode 173 and the first drive electrode 174 is disposed on a side of the first substrate 110 close to the first liquid crystal layer 172, and the other of the first common electrode 173 and the first drive electrode 174 is disposed on a side of the second substrate 171 close to the first liquid crystal layer 172. An orthographic projection of the first signal line 140 on the first substrate 110 is at least partially overlapped with an orthographic projection of the first liquid crystal layer 172 on the first substrate 110. The first phase modulator 170 can adjust the orientation of liquid crystal molecules in the first liquid crystal layer 172 through voltages on the first common electrode 173 and the first drive electrode 174 to change an effective dielectric constant of the first liquid crystal layer 172, thereby modulating the phase of the electromagnetic wave of the first signal line 140. In addition, the first phase modulator adopting a liquid crystal antenna structure also has the advantages of small volume, light weight and the like, and is more beneficial to realizing miniaturization of the antenna structure provided by the embodiment of the present disclosure. It should be noted that the radiation patch 120 is also shown in FIG. 2A (indicated by a dashed box in the figure), and the radiation patch 120 is not overlapped with the first liquid crystal layer 172, so it is indicated by a dashed box.

For example, as illustrated by FIG. 2A, the first common electrode 173 may be disposed on a side of the first substrate 110 close to the first liquid crystal layer 172, and the first drive electrode 174 may be disposed on a side of the second substrate 171 close to the first liquid crystal layer 172. Of course, embodiments of the present disclosure include but are not limited thereto. The first drive electrode 174 may also be disposed on a side of the first substrate 110 close to the first liquid crystal layer 172, and the first common electrode 173 may be disposed on a side of the second substrate 171 close to the first liquid crystal layer 172.

For example, in some examples, as illustrated by FIG. 2A, the first signal line 140 is located between the second substrate 171 and the first drive electrode 174. Of course, the embodiments of the present disclosure include but are not limited thereto. In a case where the first common electrode is located on the side of the second substrate close to the first liquid crystal layer, the first signal line is located on a side of the first liquid crystal layer away from the first common electrode to ensure that the first liquid crystal layer is disposed between the first signal line and the first common electrode, thereby realizing the modulation of the phase of the electromagnetic wave of the first signal line by the first liquid crystal layer.

For example, in some examples, as illustrated by FIG. 2A, the first phase modulator 170 further includes a first sealant 177 located between the first substrate 110 and the second substrate 171 and configured to define the first liquid crystal layer 172. Thus, the first substrate 110, the second substrate 171 and the first sealant 177 can form a liquid crystal cell to accommodate liquid crystal molecules for forming the first liquid crystal layer 172.

For example, in some examples, as illustrated by FIG. 2A, the radiation patch 120 is located on a side of the second substrate 171 away from the first liquid crystal layer 172. Of course, embodiments of that present disclosure include but are not limited to thereto.

Figure 2B:
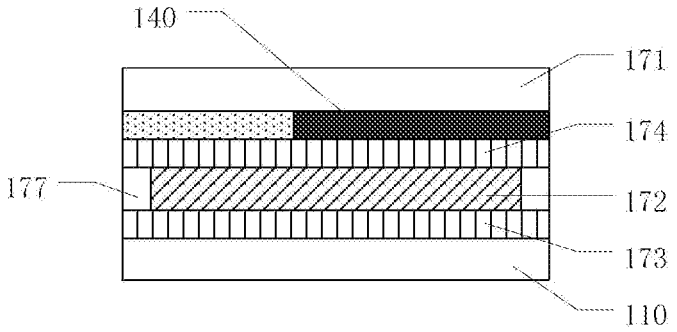
FIG. 2B is a schematic cross-sectional view of a first phase modulator in another antenna structure according to an embodiment of the present disclosure.

FIG. 2B is a schematic cross-sectional view of a first phase modulator in another antenna structure according to an embodiment of the present disclosure. As illustrated by FIG. 2B, the radiation patch 120 is located on a side of the second substrate 171 close to the first liquid crystal layer 172 and is located in the same layer as the first signal line 140.

It should be noted that, in the technical solution illustrated by FIG. 2B, the radiation patch 120 can be overlapped with the first liquid crystal layer 172. In this case, the radiation patch 120 is overlapped with the first liquid crystal layer 172, therefore, the area occupied by the antenna structure can be further reduced.

Figure 3:
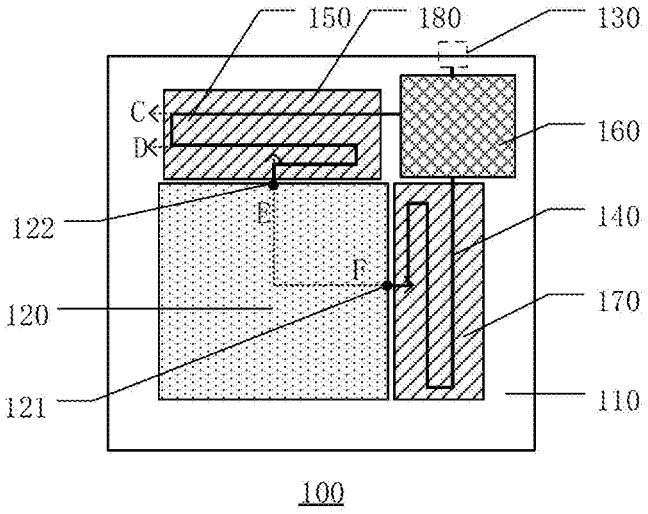
FIG. 3 is a schematic plan view of another antenna structure provided according to an embodiment of the present disclosure.

FIG. 3 is a schematic diagram of another antenna structure provided according to an embodiment of the present disclosure. As illustrated by FIG. 3, the antenna structure further includes a second phase modulator 180. The second phase modulator 180 may modulate the phase of the electromagnetic wave of the second signal line 150. Thus, the first phase modulator 170 modulates the phase of the electromagnetic wave of the first signal line 140. The second phase modulator 180 modulates the phase of the electromagnetic wave of the second signal line 150. Upon the phase difference between the first line polarization wave of the first signal line 140 modulated by the first phase modulator 170 and the second line polarization wave of the second signal line 150 modulated by the second phase modulator 180 being ±90 degrees, the first line polarization wave of the first signal line 140 and the second line polarization wave of the second signal line 150 can form a circular polarization wave on the radiation patch 120, which is received and transmitted from the radiation patch 120. Upon the phase difference between the first line polarization wave of the first signal line 140 modulated by the first phase modulator 170 and the second line polarization wave of the second signal line 150 modulated by the second phase modulator 180 being 0 degree, the first line polarization wave of the first signal line 140 and the second line polarization wave of the second signal line 150 can form a line polarization wave on the radiation patch 120, which can be transmitted and received from the radiation patch 120. Upon the antenna structure provided by the embodiment of the present disclosure receives a circular polarization wave (including a left-handed circular polarization wave or a right-handed circular polarization wave), the circular polarization wave can be decomposed into two orthogonal line polarization waves at the radiation patch 120 and transmitted to the radio frequency port 130 through the first signal line 140 and the second signal line 150, respectively. Thus, by controlling the first phase modulator 170 and the second phase modulator 180, the antenna structure can receive and transmit a left-handed circular polarization wave, a right-handed circular polarization wave, and a line polarization wave by utilizing a single radio frequency port.

For example, in some examples, as illustrated by FIG. 3, a first connection line between the first feed point 121 and a center of the radiation patch 120 is perpendicular to a second connection line between the second feed point 122 and the center of the radiation patch 120. Therefore, it can be guaranteed that the line polarization waves of the first feed point 121 and the second feed point 122 are orthogonal, thereby facilitating the formation of a circular polarization wave.

For example, in some examples, as illustrated by FIG. 3, an orthographic projection of the first phase modulator 170 on the first substrate 110 is located on a side of an orthographic projection of the radiation patch 120 on the first substrate 110 where the first feed point 121 is located, and an orthographic projection of the second phase modulator 180 on the first substrate 110 is located on a side of the orthographic projection of the radiation patch 120 on the first substrate 110 where the second feed point 122 is located. Therefore, in the case where the antenna structure includes two phase modulators, namely the first phase modulator and the second phase modulator, a space can be fully utilized to further reduce a volume of the antenna structure.

For example, in some examples, as illustrated by FIG. 3, the orthographic projection of the first phase modulator 170 on the first substrate 110 is spaced apart from the orthographic projection of the radiation patch 120 on the first substrate 110, and the orthographic projection of the second phase modulator 180 on the first substrate 110 is spaced apart from the orthographic projection of the radiation patch 120 on the first substrate 110.

For example, in some examples, a dielectric constant range of liquid crystal molecules in the first liquid crystal layer includes $\varepsilon_{\parallel}1-\varepsilon_{\perp}2$, and a length $L_1$ of a portion of the first signal line being overlapped with the first liquid crystal layer satisfies:

$$\frac{2\pi f_1 L_1}{c}\left|\sqrt{\varepsilon_{\parallel}1}-\sqrt{\varepsilon_{\perp}2}\right| \geq \frac{\pi}{2}$$

$\varepsilon_{|}1$ is a parallel dielectric constant of liquid crystal molecules in the first liquid crystal layer, $\varepsilon_{\perp}2$ is a vertical dielectric constant of the liquid crystal molecules in the first liquid crystal layer, c is the speed of light, and $f_1$ is the frequency of the electromagnetic wave of the first signal line.

For example, in some examples, a dielectric constant range of liquid crystal molecules of the second liquid crystal layer comprises $\varepsilon_{|}3-\varepsilon_{\perp}4$, and a length $L_2$ of a portion of the second signal line being overlapped with the second liquid crystal layer satisfies:

$$\frac{2\pi f_2 L_2}{c}\left|\sqrt{\varepsilon_{|}3}-\sqrt{\varepsilon_{\perp}4}\right| \geq \frac{\pi}{2}.$$

$\varepsilon_{|}3$ is a parallel dielectric constant of the liquid crystal molecules in the second liquid crystal layer, $\varepsilon_{|}4$ is a vertical dielectric constant of the liquid crystal molecules in the second liquid crystal layer, c is the speed of light, and $f_2$ is the frequency of the electromagnetic wave of the second signal line.

Figure 4:
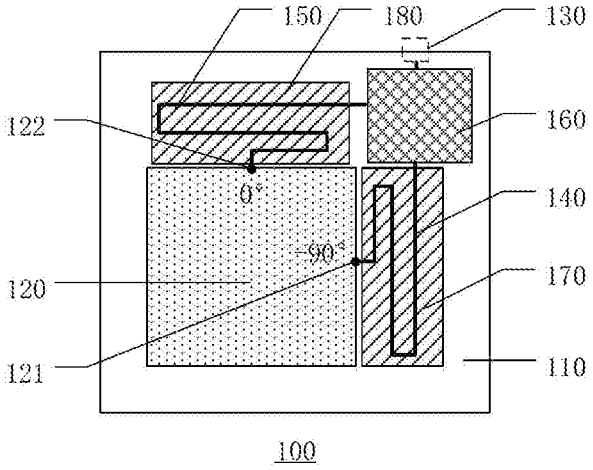
FIG. 4 is an operational schematic diagram of an antenna structure according to an embodiment of the present disclosure.

FIG. 4 is an operational schematic diagram of an antenna structure according to an embodiment of the present disclosure. As illustrated by FIG. 4, the second phase modulator 180 does not modulate the phase of the electromagnetic wave of the second signal line 150. The first phase modulator 170 modulates the phase of the electromagnetic wave of the first signal line 140 so as to generate the phase difference of −90 degrees between the phase of the electromagnetic wave of the first signal line 140 and the phase of the electromagnetic wave of the second signal line. The first line polarization wave of the first signal line 140 and the second line polarization wave of the second signal line 150 can be transmitted to the radiation patch 120 through the first feed point 121 and the second feed point 122, respectively, and can form a left-handed circular polarization wave on the radiation patch 120, which is received and transmitted from the radiation patch 120.

Figure 5:
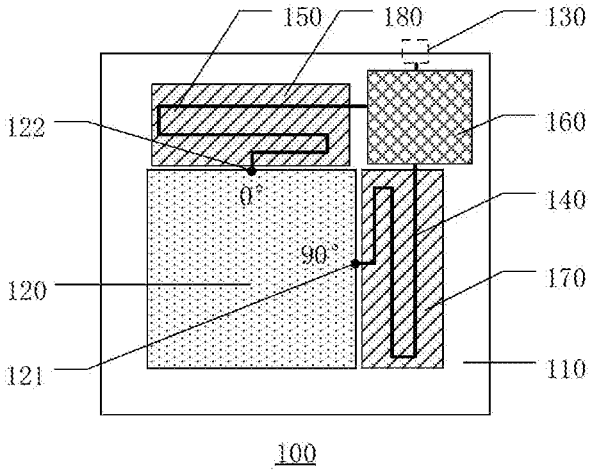
FIG. 5 is an operational schematic diagram of another antenna structure provided according to an embodiment of the present disclosure.

FIG. 5 is an operational schematic diagram of another antenna structure provided according to an embodiment of the present disclosure. As illustrated by FIG. 5, the second phase modulator 180 does not modulate the phase of the electromagnetic wave of the second signal line 150. The first phase modulator 170 modulates the phase of the electromagnetic wave of the first signal line 140 so as to generate the phase difference of 90 degrees between the phase of the electromagnetic wave of the first signal line 140 and the phase of the electromagnetic wave of the second signal line. The first line polarization wave of the first signal line 140 and the second line polarization wave of the second signal line 150 can be transmitted to the radiation patch 120 through the first feed point 121 and the second feed point 122, respectively, and can form a right-handed circular polarization wave on the radiation patch 120, which is received and transmitted from the radiation patch 120.

Figure 6:
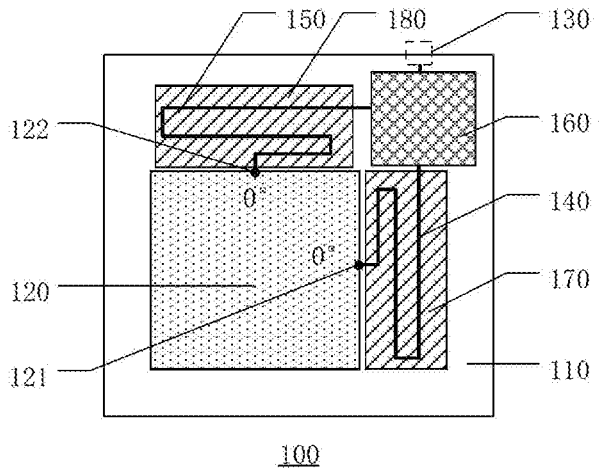
FIG. 6 is an operational schematic diagram of another antenna structure provided according to an embodiment of the present disclosure.

FIG. 6 is an operational schematic diagram of another antenna structure provided according to an embodiment of the present disclosure. As illustrated by FIG. 6, the first phase modulator 170 does not modulate the phase of the electromagnetic wave of the first signal line 140. The second phase modulator 180 does not modulate the phase of the electromagnetic wave of the second signal line 150. The first line polarization wave of the first signal line 140 and the second line polarization wave of the second signal line 150 can be transmitted to the radiation patch 120 through the first feed point 121 and the second feed point 122, respectively, and form a line polarization wave on the radiation patch 120, which is received and transmitted from the radiation patch 120.

It should be noted that, the working states of the antenna structure provided by the embodiments of the present disclosure are not limited to the several situations described in FIGS. 4-6, and the phases of the electromagnetic waves of the first signal line and the second signal line can be modulated by the first phase modulator and the second phase modulator respectively according to the actual situation.

Figure 7A:
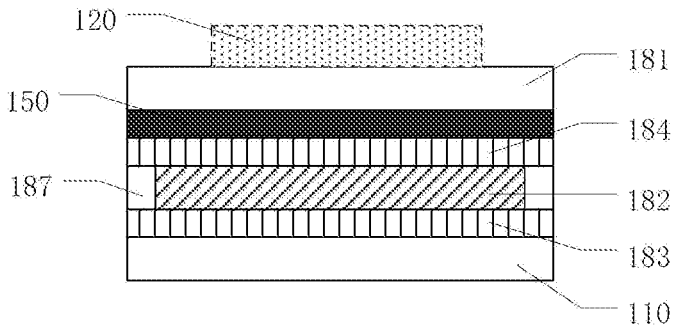
FIG. 7A is a schematic cross-sectional view of a second phase modulator in an antenna structure according to an embodiment of the present disclosure.

For example, in some examples, the second phase modulator 180 may also adopt a similar structure to the first phase modulator 170. FIG. 7A is a schematic cross-sectional view of a second phase modulator in an antenna structure according to an embodiment of the present disclosure. FIG. 7A is a schematic cross-sectional view taken along the CD line shown in FIG. 3. As illustrated by FIG. 7A, the second phase modulator 180 includes a third substrate 181 disposed opposite to the first substrate 110, a second liquid crystal layer 182, a second common electrode 183 and a second drive electrode 184 sandwiched between the first substrate 110 and the third substrate 181. One of the second common electrode 183 and the second drive electrode 184 is disposed on a side of the first substrate 110 close to the second liquid crystal layer 182, and the other of the second common electrode 183 and the second drive electrode 184 is disposed on a side of the third substrate 181 close to the second liquid crystal layer 182. An orthographic projection of the second signal line 150 on the first substrate 110 is at least partially overlapped with an orthographic projection of the second liquid crystal layer 182 on the first substrate 110. The second phase modulator 180 can adjust the orientation of the liquid crystal molecules in the second liquid crystal layer 182 through voltages on the second common electrode 183 and the second drive electrode 184 to change an effective dielectric constant of the second liquid crystal layer 182, thereby modulating the phase of electromagnetic wave of the second signal line 150. In addition, the second phase modulator adopting a liquid crystal antenna structure also has the advantages of small volume, light weight and the like, and is more beneficial to realizing miniaturization of the antenna structure provided by the embodiment of the disclosure. It should be noted that, the radiation patch 120 is also shown in FIG. 7A (indicated by a dashed box in the figure), and the radiation patch 120 is not overlapped with the second liquid crystal layer 182, so the radiation patch 120 is indicated by a dashed box.

For example, as illustrated by FIG. 7A, the second common electrode 183 may be disposed on the side of the first substrate 110 close to the second liquid crystal layer 182, and the second drive electrode 184 may be disposed on a side of the third substrate 181 close to the second liquid crystal layer 182. Of course, the embodiments of the present disclosure include but are not limited thereto. The second drive electrode 184 may also be disposed on the side of the first substrate 110 close to the second liquid crystal layer 182, and the second common electrode 183 may be disposed on the side of the third substrate 181 close to the second liquid crystal layer 182.

For example, in some examples, as illustrated by FIG. 7A, the second phase modulator 180 further includes a second sealant 187 located between the first substrate 110 and the third substrate 181 and configured to define the second liquid crystal layer 182. Thus, the first substrate 110, the third substrate 181, and the second sealant 187 can form a liquid crystal cell to accommodate the liquid crystal molecules for forming the second liquid crystal layer 182.

For example, in some examples, as illustrated by FIG. 7A, the second signal line 150 is located between the third substrate 181 and the second drive electrode 184. Of course, the embodiments of the present disclosure include but are not limited thereto. In a case where the second common electrode is located on the side of the third substrate close to the second liquid crystal layer, the second signal line is located on the side of the second liquid crystal layer away from the second common electrode, so as to ensure that the second liquid crystal layer is disposed between the second signal line and the second common electrode, thereby realizing the phase modulation of the electromagnetic wave of the second signal line by the second liquid crystal layer.

For example, in some examples, as illustrated by FIG. 7A, the radiation patch 120 is located on a side of the third substrate 181 away from the second liquid crystal layer 182. Of course, embodiments of that present disclosure include, but are not limited thereto.

Figure 7B:
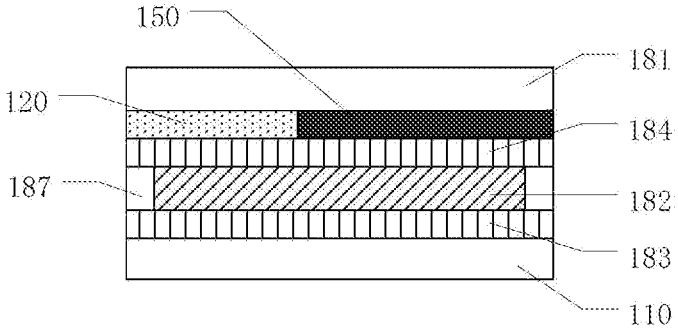
FIG. 7B is a schematic cross-sectional view of a second phase modulator in another antenna structure according to an embodiment of the present disclosure.

FIG. 7B is a schematic cross-sectional view of a second phase modulator in another antenna structure according to an embodiment of the present disclosure. As illustrated by FIG. 7B, the radiation patch 120 is located on the side of the third substrate 181 close to the second liquid crystal layer 182 and is located in the same layer as the second signal line 150.

Figure 7C:
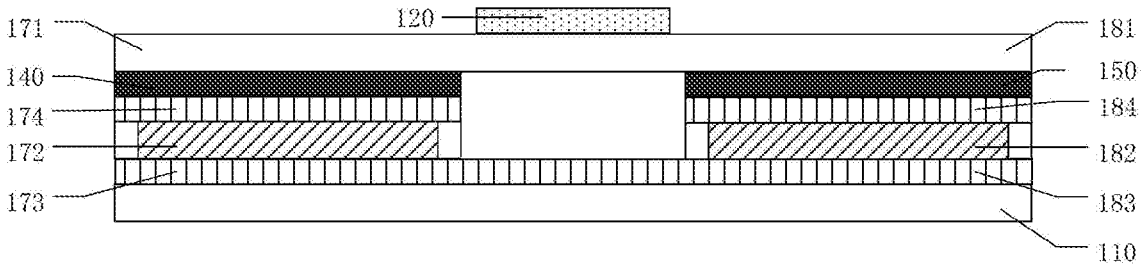
FIG. 7C is a schematic cross-sectional view of a first phase modulator and a second phase modulator in an antenna structure according to an embodiment of the present disclosure.

For example, FIG. 7C is a schematic cross-sectional view of a first phase modulator and a second phase modulator in an antenna structure according to an embodiment of the present disclosure. FIG. 7C is a schematic sectional view taken along the EF line shown in FIG. 3. As illustrated by FIG. 7C, the second substrate 171 and the third substrate 181 may be the same substrate. The first liquid crystal layer 172 and the second liquid crystal layer 182 may be disposed in the same layer. That is, the second substrate 171 in FIG. 2A and the third substrate 181 in FIG. 7A may be formed by using the same substrate. The first liquid crystal layer 172 in FIG. 2A and the second liquid crystal layer 182 in FIG. 7A may be disposed in the same layer.

For example, as illustrated by FIG. 7C, the second substrate 171 and the third substrate 181 are the same substrate, and the first common electrode 173 and the second common electrode 183 are the same common electrode on the first substrate 110. That is, the second substrate 171 in FIG. 2A and the third substrate 181 in FIG. 7A may be formed by using the same substrate. The first common electrode 173 in FIG. 2A and the second common electrode 183 in FIG. 7A may be formed by using the same electrode layer.

Figure 8:
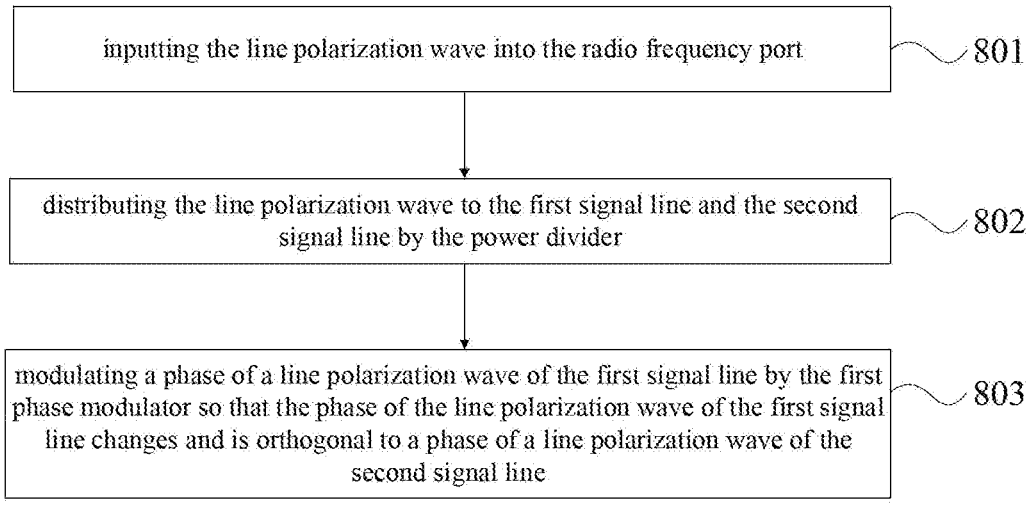
FIG. 8 is a flowchart of a modulation method of an antenna structure according to an embodiment of the present disclosure.

An embodiment of the present disclosure provides a modulation method of an antenna structure. The antenna structure includes the antenna structure described above. FIG. 8 is a flowchart of a modulation method of an antenna structure according to an embodiment of the present disclosure. As illustrated by FIG. 8, the modulation method includes steps S801-S803.

Step S801: inputting the line polarization wave into the radio frequency port.

Step S802: distributing the line polarization wave to the first signal line and the second signal line by the power divider.

Step S803: modulating a phase of a line polarization wave of the first signal line by the first phase modulator so that the phase of the line polarization wave of the first signal line changes and is orthogonal to a phase of a line polarization wave of the second signal line.

In the modulation method of the antenna structure provided by the embodiment of the present disclosure, the power divider distributes the line polarization wave of the radio frequency port to the first signal line and the second signal line; that is, the electromagnetic waves of the first signal line and the second signal line both are line polarization waves: then, the first phase modulator modulates the phase of the electromagnetic wave of the first signal line. Upon the phase difference between the first line polarization wave of the first signal line modulated by the first phase modulator and the second line polarization wave of the second signal line being, for example, ±90 degrees, the first line polarization wave of the first signal line and the second line polarization wave of the second signal line can form a circular polarization wave on the radiation patch, which is received and transmitted from the radiation patch. Upon the phase difference between the first line polarization wave of the first signal line modulated by the first phase modulator and the second line polarization wave of the second signal line being 0 degree, the first line polarization wave of the first signal line and the second line polarization wave of the second signal line can form a line polarization wave on the radiation patch, which is received and transmitted from the radiation patch. Therefore, by controlling the first phase modulator, the antenna structure can receive and transmit a left-handed circular polarization wave, a right-handed circular polarization wave, and a line polarization wave by utilizing a single radio frequency port.

It should be noted that, upon the phase of the line polarization wave of the first signal line changes and is orthogonal to the phase of the line polarization wave of the second signal line, upon the phase difference between the first line polarization wave of the first signal line and the second line polarization wave of the second signal line being not ±90 degrees or 0 degree, an elliptically polarization wave is formed on the radiation patch. Upon the power of the first line polarization wave of the first signal line and the power of the second line polarization wave of the second signal line being not equal, an elliptic polarization wave is also formed on the radiation patch. Upon the power of the first line polarization wave of the first signal line and the power of the second line polarization wave of the second signal line being equal, and the phase difference is ±90 degrees, a perfect circular polarization wave is formed on the radiation patch.

For example, in some examples, a difference between the power of the electromagnetic wave of the first signal line and the power of the electromagnetic wave of the second signal line is less than 50% of the larger one of the power of the electromagnetic wave of the first signal line and the power of the electromagnetic wave of the second signal line. Therefore, the formed circular polarization wave can be guaranteed to have a small axial ratio, which is more beneficial to the transmission and reception of information.

For example, in some examples, a step of distributing the line polarization wave to the first signal line and the second signal line by the power divider includes that the power divider distributes the electromagnetic wave of the radio frequency port to the first signal line and the second signal line with equal power, i.e., the first line polarization wave of the first signal line and the second line polarization wave of the second signal line are line polarization waves of the equal power. In this way, the circular polarization wave thus formed is a perfect circular polarization wave, thus further facilitating the transmission and reception of information.

For example, in some examples, the antenna structure further includes a second phase modulator that can modulate the phase of the electromagnetic wave of the second signal line. In this case, the abovementioned step 803 may further include that the second phase modulator further modulates the phase of the line polarization wave of the second signal line to change the phase of the line polarization wave of the second signal line.

For example, in some examples, a step of modulating the phase of the line polarization wave of the first signal line by the first phase modulator so that the phase of the line polarization wave of the first signal line changes and is orthogonal to the phase of the line polarization wave of the second signal line includes that the first phase modulator modulates the phase of the line polarization wave of the first signal line so that the phase of the line polarization wave on the first signal line is different from the phase of the line polarization wave of the second signal line by 90 degrees. Therefore, the first line polarization wave of the first signal line and the second line polarization wave of the second signal line can be transmitted to the radiation patch through the first feed point and the second feed point respectively, and a right-handed circular polarization wave can be formed on the radiation patch, and received and transmitted from the radiation patch.

For example, in some examples, a step of modulating the phase of the line polarization wave of the first signal line by the first phase modulator so that the phase of the line polarization wave of the first signal line changes and is orthogonal to the phase of the line polarization wave on the second signal line includes that the first phase modulator modulates the phase of the line polarization wave of the first signal line so that the phase of the line polarization wave of the first signal line differs from the line polarization wave of the second signal line by −90 degrees. Therefore, the first line polarization wave of the first signal line and the second line polarization wave of the second signal line can be transmitted to the radiation patch through the first feed point and the second feed point respectively, and a left-handed circular polarization wave can be formed on the radiation patch, and received and transmitted from the radiation patch.

The following points need to be explained:

(1) In the drawings of the embodiments of the present disclosure, only the structures related to the embodiments of the present disclosure are involved, and other structures may refer to the common design.

(2) Without conflict, features in the same embodiment and different embodiments of the present disclosure can be combined with each other.

The foregoing is only specific embodiments of the present disclosure, but the protection scope of the present disclosure is not limited thereto. Any person skilled in the art can easily envisage modifications or alternations within the technical scope of the present disclosure, and should fall within the protection scope of the present disclosure. Therefore, the scope of protection of the present disclosure shall be defined by the claims.

What is claimed is:

1. An antenna structure, comprising:

a radiation patch, comprising a first feed point and a second feed point;

a radio frequency port;

a first signal line, one end of the first signal line being connected with the first feed point;

a second signal line, one end of the second signal line being connected with the second feed point;

a power divider, respectively connected with the radio frequency port, the other end of the first signal line, and the other end of the second signal line, and configured to distribute an electromagnetic wave of the radio frequency port to the first signal line and the second signal line; and a first phase modulator, configured to modulate a phase of an electromagnetic wave of the first signal line;

the antenna structure further comprises a first substrate, and the first phase modulator comprising:

a second substrate, opposite to the first substrate;

a first liquid crystal layer, sandwiched between the first substrate and the second substrate; and a first common electrode and a first drive electrode, one of the first common electrode and the first drive electrode being located on a side of the first liquid crystal layer close to the first substrate, and the other of the first common electrode and the first drive electrode being located on a side of the first liquid crystal layer close to the second substrate, wherein an orthographic projection of the first signal line on the first substrate is at least partially overlapped with an orthographic projection of the first liquid crystal layer on the first substrate; and an orthographic projection of the radiation patch on the first substrate is not overlapped with the orthographic projection of the first liquid crystal layer on the first substrate.

2. The antenna structure according to claim 1, wherein a difference between a power of the electromagnetic wave of the first signal line and a power of an electromagnetic wave of the second signal line is less than 50% of the larger one of the power of the electromagnetic wave of the first signal line and the power of the electromagnetic wave of the second signal line.

3. The antenna structure according to claim 1, wherein the power divider is configured to distribute the electromagnetic wave of the radio frequency port to the first signal line and the second signal line with equal power.

4. The antenna structure according to claim 1, further comprising:

a second phase modulator, configured to modulate a phase of an electromagnetic wave of the second signal line.

5. The antenna structure according to claim 4, wherein the second phase modulator comprises:

a third substrate, opposite to the first substrate;

a second liquid crystal layer, sandwiched between the first substrate and the third substrate; and a second common electrode and a second drive electrode, one of the second common electrode and the second drive electrode being located on a side of the second liquid crystal layer close to the first substrate, the other of the second common electrode and the second drive electrode being located on a side of the second liquid crystal layer close to the third substrate, wherein an orthographic projection of the second signal line on the first substrate is at least partially overlapped with an orthographic projection of the second liquid crystal layer on the first substrate.

6. The antenna structure according to claim 5, wherein a dielectric constant range of liquid crystal molecules of the second liquid crystal layer comprises $\varepsilon_{|}3$-$\varepsilon_{|}4$, and a length $L_2$ of a portion of the second signal line overlapped with the second liquid crystal layer satisfies:

$$\frac{2\pi f_2 L_2}{c}\left|\sqrt{\varepsilon_{\parallel}3}-\sqrt{\varepsilon_{\perp}4}\right| \geq \frac{\pi}{2},$$

wherein $\varepsilon_{|}3$ is a parallel dielectric constant of the liquid crystal molecules in the second liquid crystal layer, $\varepsilon_{|}4$ is a vertical dielectric constant of the liquid crystal molecules in the second liquid crystal layer, c is the speed of light, and $f_2$ is a frequency of the electromagnetic wave of the second signal line.

7. The antenna structure according to claim 5, wherein the first signal line is located between the second substrate and the first drive electrode, or between the second substrate and the first common electrode.

8. The antenna structure according to claim 7, wherein the second signal line is located between the third substrate and the second drive electrode, or between the third substrate and the second common electrode.

9. The antenna structure according to claim 8, wherein the first signal line is located on a side of the first liquid crystal layer away from the first common electrode, and the second signal line is located on a side of the second liquid crystal layer away from the second common electrode.

10. The antenna structure according to claim 5, wherein the second substrate and the third substrate are a same substrate, the first liquid crystal layer and the second liquid crystal layer are disposed in a same layer, and the first common electrode and the second common electrode are a same common electrode.

11. The antenna structure according to claim 10, wherein the radiation patch is located on a side of the second substrate away from the first liquid crystal layer.

12. The antenna structure according to claim 10, wherein the radiation patch is located on a side of the second substrate close to the first liquid crystal layer, and is in the same layer as the first signal line.

13. The antenna structure according to claim 12, wherein an orthographic projection of the radiation patch on the first substrate is overlapped with the orthographic projection of the first liquid crystal layer or the second liquid crystal layer on the first substrate.

14. The antenna structure according to claim 5, wherein a first connection line between the first feed point and a center of the radiation patch is perpendicular to a second connection line between the second feed point and the center of the radiation patch.

15. The antenna structure according to claim 14, wherein an orthographic projection of the first phase modulator on the first substrate is located on a side of an orthographic projection of the radiation patch on the first substrate where the first feed point is located, and an orthographic projection of the second phase modulator on the first substrate is located on a side of the orthographic projection of the radiation patch on the first substrate where the second feed point is located.

16. The antenna structure according to claim 5, wherein an orthographic projection of the first phase modulator on the first substrate is spaced apart from an orthographic projection of the radiation patch on the first substrate, and an orthographic projection of the second phase modulator on the first substrate is spaced apart from an orthographic projection of the radiation patch on the first substrate.

17. The antenna structure according to claim 1, wherein a dielectric constant range of liquid crystal molecules in the first liquid crystal layer comprises $\varepsilon_{|}1$-$\varepsilon_{|}2$, and a length $L_1$ of a portion of the first signal line overlapped with the first liquid crystal layer satisfies:

$$\frac{2\pi f_1 L_1}{c}\left|\sqrt{\varepsilon_{\parallel}1} - \sqrt{\varepsilon_{\perp}2}\right| \geq \frac{\pi}{2},$$

wherein $\varepsilon_{|}1$ is a parallel dielectric constant of the liquid crystal molecules in the first liquid crystal layer, $\varepsilon_{|}2$ is a vertical dielectric constant of the liquid crystal molecules in the first liquid crystal layer, c is the speed of light, and $f_1$ is a frequency of the electromagnetic wave of the first signal line.

18. The antenna structure according to claim 1, wherein a number of the radio frequency port is one.

19. A modulation method of an antenna structure according to claim 1, the modulation method comprising:

inputting an electromagnetic wave into the radio frequency port, the electromagnetic wave being a line polarization wave;

distributing the line polarization wave to the first signal line and the second signal line by the power divider; and modulating a phase of a line polarization wave of the first signal line by the first phase modulator so that the phase of the line polarization wave of the first signal line changes and is orthogonal to a phase of a line polarization wave of the second signal line.

* * * * *